US007477195B2

(12) United States Patent
Vance

(10) Patent No.: US 7,477,195 B2
(45) Date of Patent: Jan. 13, 2009

(54) MULTI-FREQUENCY BAND ANTENNA DEVICE FOR RADIO COMMUNICATION TERMINAL

(75) Inventor: Scott La Dell Vance, Staffanstorp (SE)

(73) Assignee: Sony Ericsson Mobile Communications AB, Lund (SE)

( * ) Notice: Subject to any disclaimer, the term of this patent is extended or adjusted under 35 U.S.C. 154(b) by 174 days.

(21) Appl. No.: 11/498,043

(22) Filed: Aug. 3, 2006

(65) Prior Publication Data

US 2007/0210969 A1 Sep. 13, 2007

Related U.S. Application Data

(60) Provisional application No. 60/779,427, filed on Mar. 7, 2006.

(51) Int. Cl.
*H01Q 1/38* (2006.01)

(52) U.S. Cl. ..... 343/700 MS; 343/702

(58) Field of Classification Search ..... 343/700 MS, 343/702, 846

See application file for complete search history.

(56) References Cited

U.S. PATENT DOCUMENTS 6,433,745 B1 * 8/2002 Nagumo et al. ..... 343/700 MS
6,650,294 B2 11/2003 Ying et al.
6,680,705 B2 * 1/2004 Tan et al. ..... 343/702

FOREIGN PATENT DOCUMENTS

| | | | |
|---|---|---|---|
| EP | 0 871 238 | A2 | 10/1998 |
| EP | 1 351 334 | A1 | 10/2003 |
| WO | WO 02/078123 | A1 | 10/2002 |
| WO | WO 02/078124 | A1 | 10/2002 |
| WO | WO 03/047031 | A1 | 6/2003 |
| WO | 2005/057722 | | 6/2005 |

OTHER PUBLICATIONS

Rowell, Corbett R. et al., "A Compact PIFA Suitable for Dual-Frequency 900/1800-MHz Operation," *IEEE Transactions on Antennas and Propagation*, vol. 46, No. 4, pp. 596-598 (Apr. 1988).

* cited by examiner

*Primary Examiner*—HoangAnh T Le
(74) *Attorney, Agent, or Firm*—Harrity & Harrity, LLP

(57) ABSTRACT

A multi-band radio antenna device for a radio communication terminal includes an integral feed and ground structure electrically connected to a first radiating antenna element and a second radiating antenna element. The first radiating antenna element includes a first continuous trace of conductive material, wherein the first continuous trace has a first branch tuned to radiate at first frequencies in a first frequency band, and a second branch, which is tuned to radiate in a second frequency band at second frequencies approximately equal to or greater than two times the first frequencies. The said second radiating antenna element has a second continuous trace of conductive material, wherein the second continuous trace has a third branch capacitively coupled to the second branch. Such an antenna device is suitable for built-in antennas, at the same time having a wide high-frequency band bandwidth, which enables the antenna to be operable at a number of frequency bands.

20 Claims, 6 Drawing Sheets

MULTI-FREQUENCY BAND ANTENNA DEVICE FOR RADIO COMMUNICATION TERMINAL

RELATED APPLICATIONS

This application claims priority under 35 U.S.C. § 119 based on U.S. Provisional Application Ser. No. 60/779,427, filed Mar. 7, 2006, the disclosure of which is incorporated herein by reference.

FIELD OF THE INVENTION

This invention pertains in general to the field of antennas for radio communication terminals and, in particular, to compact multi-frequency band antennas devised to be incorporated or built-in into mobile or portable radio communication terminals and having a wide high-bandwidth to facilitate operation of such terminals.

BACKGROUND OF THE INVENTION

The use of radio communication networks is rapidly becoming a part of the daily life for more and more people around the globe. For instance, the GSM (Global System for Mobile Communications) networks offer a variety of functions. Generally, radio communication systems based on such networks use radio signals transmitted by a base station in the downlink over the traffic and control channels are received by mobile or portable radio communication terminals, each of which have at least one antenna. Historically, portable terminals have employed a number of different types of antennas to receive and transmit signals over the air interface. In addition, mobile terminal manufacturers encounter a constant demand for smaller and smaller terminals. This demand for miniaturization is combined with a desire for additional functionality, such as having the ability to use the terminal at different frequency bands, e.g., of different cellular systems, so that a user of the mobile terminal may use a single, small radio communication terminal in different parts of the world having cellular networks operating according to different standards at different frequencies.

Further, it is commercially desirable to offer portable terminals that are capable of operating in widely different frequency bands, e.g., bands located in the 800 MHz, 900 MHz, 1800 MHz, 1900 MHz and 2.1 GHz regions. Accordingly, antennas, which provide adequate gain and bandwidth in a plurality of these frequency bands, are employed in portable terminals.

The general desire today is to have an antenna, which is positioned inside the housing of a mobile communication terminal. Several attempts have been made to create such antennas.

For instance, U.S. Pat. No. 6,650,294 of Ying et. al., discloses broadband multi-resonant antennas that utilize a capacitive coupling between multiple conductive plates for compact antenna applications. The number and design of conductive plates is set to achieve the desired bandwidth. One of the antennas discloses by Ying is designed for four resonant frequencies and includes three L shaped legs, each including a micro-strip conductive plate and connection pin, with configurations approximately parallel to one another, wherein the center L shaped leg is a feed patch with a feed pin connected to a transmitter, receiver, or transceiver. The upper L shaped leg is a dual band main patch and ground pin. The dual band main patch has two different branches with different lengths and areas to handle three of four desired resonant frequencies.

The lower L shaped leg is a parasitic high band patch and ground pin designed to handle one of the two higher desired resonant frequencies. Ying has proposed an antenna that uses a capacitive feed structure and capacitive coupling along the low-band branch in order to achieve improved bandwidth at the low-band. However, the multi-layer design with capacitive coupling proposed by Ying has somewhat reduced performance in the low-bands and does not have sufficient bandwidth in the high-bands, for instance to achieve a suitable digital cellular service (DCS)/personal communication service (PCS)/universal mobile telecommunications system (UMTS) performance.

Another example for an antenna is disclosed in WO2005/057722, by Antenova Limited, wherein a high-dielectric ceramic pellet is used as part of a feed structure. More precisely, the antenna structure disclosed in WO2005/057722 has a dielectric pellet and a dielectric substrate with upper and lower surfaces and a ground plane. The dielectric pellet is provided with a conductive direct feed structure. Further, a radiating antenna component is additionally provided and arranged, so as to be excited by the dielectric pellet. This design may in particular achieve broad bandwidth in the high-band, especially when using matching components. However, an antenna structure as proposed by WO2005/057722 may have reduced gain. Additionally, the cost of implementation can be prohibitive due to the elevated costs of the specialized ceramic materials, as specific dielectric pellets made of a highly specialized ceramic material are needed.

Hence, an improved multi-band radio antenna device having a wide high-bandwidth would be advantageous. In particular a multi-band radio antenna device allowing for increased efficiency with regard to, e.g., size, cost, bandwidth, design flexibility and/or radiation efficiency of the multi-band radio antenna device would be advantageous. It is desirable to achieve an antenna supporting at least a single low-band and a wide range of multiple high-bands.

More specifically, an antenna with very broad high-band would be advantageous, which is both small and has good performance also in a low frequency band, such as the 900 MHz GSM band. The high-band performance is desired to be good in several higher frequency bands, such as the 1800 MHz GSM or DCS band, the 1900 MHz GSM or PCS band, and the 2.1 GHz UMTS band.

Hence, an improved multi-band antenna would be advantageous, and in particular a multi-band antenna allowing for increased performance, flexibility, or cost-effectiveness, would be advantageous.

SUMMARY OF THE INVENTION

According to an embodiment, a multi-band radio antenna device for a radio communication terminal is provided, wherein the multi-band radio antenna device comprises an integral feed and ground structure electrically connected to a first radiating antenna element and a second radiating antenna element, wherein said first radiating antenna element comprises a first continuous trace of conductive material, and wherein the first continuous trace has a first branch that is tuned to radiate at first frequencies in a first frequency band, and a second branch, which is tuned to radiate in a second frequency band at second frequencies approximately equal to or greater than two times the first frequencies. The second radiating antenna element comprises a second continuous trace of conductive material, wherein the second continuous trace has a third branch capacitively coupled to said second branch.

According to some embodiments of the multi-band radio antenna device, the third branch may be a feeding branch of the multi-band radio antenna device, which may be connected to a HF feeding connection point of said integral feed and ground structure.

According to some embodiments of the multi-band radio antenna device, the third radiating antenna element may comprise a third continuous trace of conductive material, wherein the third continuous trace has a fourth branch tuned to resonate in a third frequency band at third frequencies that are higher than the second frequencies, and which is capacitively coupled to the feed and ground structure and arranged substantially adjacent to the second branch.

According to some embodiments of the multi-band radio antenna device, the fourth branch may be substantially arranged in the same plane as said first branch and said second branch.

According to some embodiments of the multi-band radio antenna device, the fourth branch may be a parasitic element that in use tunes a lower high-band resonance of the antenna device.

According to some embodiments of the multi-band radio antenna device, the second branch may be an inner high-band element of the antenna device, and the third branch may be a capacitive feeding structure, wherein a higher high-band resonance in use is tuned with the second branch, as well as the third branch, which is assembled on a carrier element opposite this second branch, wherein the second branch and said third branch substantially overlap.

According to some embodiments of the multi-band radio antenna device, the carrier element may be a dielectric carrier element and said first, second and third conductive antenna traces are attached to said carrier element.

According to some embodiments of the multi-band radio antenna device, the second branch and the third branch may substantially overlap and may be arranged on opposite surfaces of said dielectric carrier element, having a dielectric material of said carrier element in-between.

According to some embodiments of the multi-band radio antenna device, the first branch may be a U-shaped element having a lower resonance of the antenna device in said first frequency band, wherein said lower resonance is tuned with said U-shaped element.

According to some embodiments of the multi-band radio antenna device, the first branch of said first continuous trace of conductive material of said first radiating antenna element may be connected to a ground feed of said feed and ground structure, and a series matching component may further be connected between said ground feed and ground, whereby said matching component in use may tune the lower resonance of the antenna device in said first frequency band and may match it to a predefined impedance.

According to some embodiments of the multi-band radio antenna device, said matching element may be a capacitor having a capacitance.

According to some embodiments of the multi-band radio antenna device said capacitance may be between 1 pF and 20 pF and said impedance may be 50 Ohms.

According to some embodiments, the multi-band radio antenna device may further comprise a carrier element that comprises a substantially planar part having an upper surface, a lower surface and a lateral surface over the thickness of the planar part and around the outer edge thereof, and having a defined height.

According to some embodiments of the multi-band radio antenna device, the substantially planar part may comprise a wall entrance of the mobile terminal, the wall entrance being used for at least one of a through connection, a camera lens, or an external antenna connector.

According to some embodiments of the multi-band radio antenna device, said carrier element may further comprise a protruding part protruding over said upper surface, wherein said protruding part may have said integral feed and ground structure arranged thereon.

According to some embodiments of the multi-band radio antenna device, said protruding part may be configured as part of a mechanical connector for said integral feed and ground structure.

According to some embodiments of the multi-band radio antenna device, said first and second branches may be arranged on said lower surface, and wherein said third branch may be arranged on the upper surface, opposite to the second branch, and wherein said third branch and the second branch substantially overlap.

According to another embodiment, a radio communication terminal for multi-band radio communication is provided, wherein the radio communication terminal comprises an integral feed and ground structure electrically connected to a first radiating antenna element and a second radiating antenna element, wherein said first radiating antenna element comprises a first continuous trace of conductive material, and wherein the first continuous trace has a first branch tuned to radiate at first frequencies in a first frequency band, and a second branch, which is tuned to radiate in a second frequency band at second frequencies approximately equal to or greater than two times the first frequencies, and wherein said second radiating antenna element comprising a second continuous trace of conductive material, the second continuous trace having a third branch capacitively coupled to said second branch.

According to some embodiments, the radio communication terminal may be a mobile telephone.

According to another embodiment, a method of tuning a frequency band of a multi-band radio antenna device for a radio communication terminal is provided. More precisely, a method is provided in a radio communication terminal having a multi-band radio antenna device comprising an integral feed and ground structure electrically connected to a first radiating antenna element and a second radiating antenna element, said first radiating antenna element comprising a first continuous trace of conductive material, the first continuous trace having a first branch tuned to radiate at first frequencies in a first frequency band, and a second branch, which is tuned to radiate in a second frequency band at second frequencies approximately equal to or greater than two times the first frequencies, and said second radiating antenna element comprising a second continuous trace of conductive material, the second continuous trace having a third branch. The method is more precisely a method of tuning said second frequency band, and said method comprises capacitively coupling said third branch to said second branch through a common dielectric carrier element.

Some embodiments of the invention may provide for significant bandwidth in high-bands without the use of expensive ceramic components.

Some embodiments of the invention may provide for advantageous performance in a small volume, which for instance allows for small, more attractive phones.

Some embodiments of the invention may provide for an antenna device that is advantageously suitable for built-in antennas, at the same time having a wide high-frequency band bandwidth, which enables the antenna to be operable at a plurality of frequency bands.

BRIEF DESCRIPTION OF THE DRAWINGS

These and other aspects, features and advantages of which the invention, amongst others, is capable of will be apparent and elucidated from the following description of an embodiment of the present invention, reference being made to the accompanying drawings, in which.

DETAILED DESCRIPTION OF THE INVENTION

Figure 1:
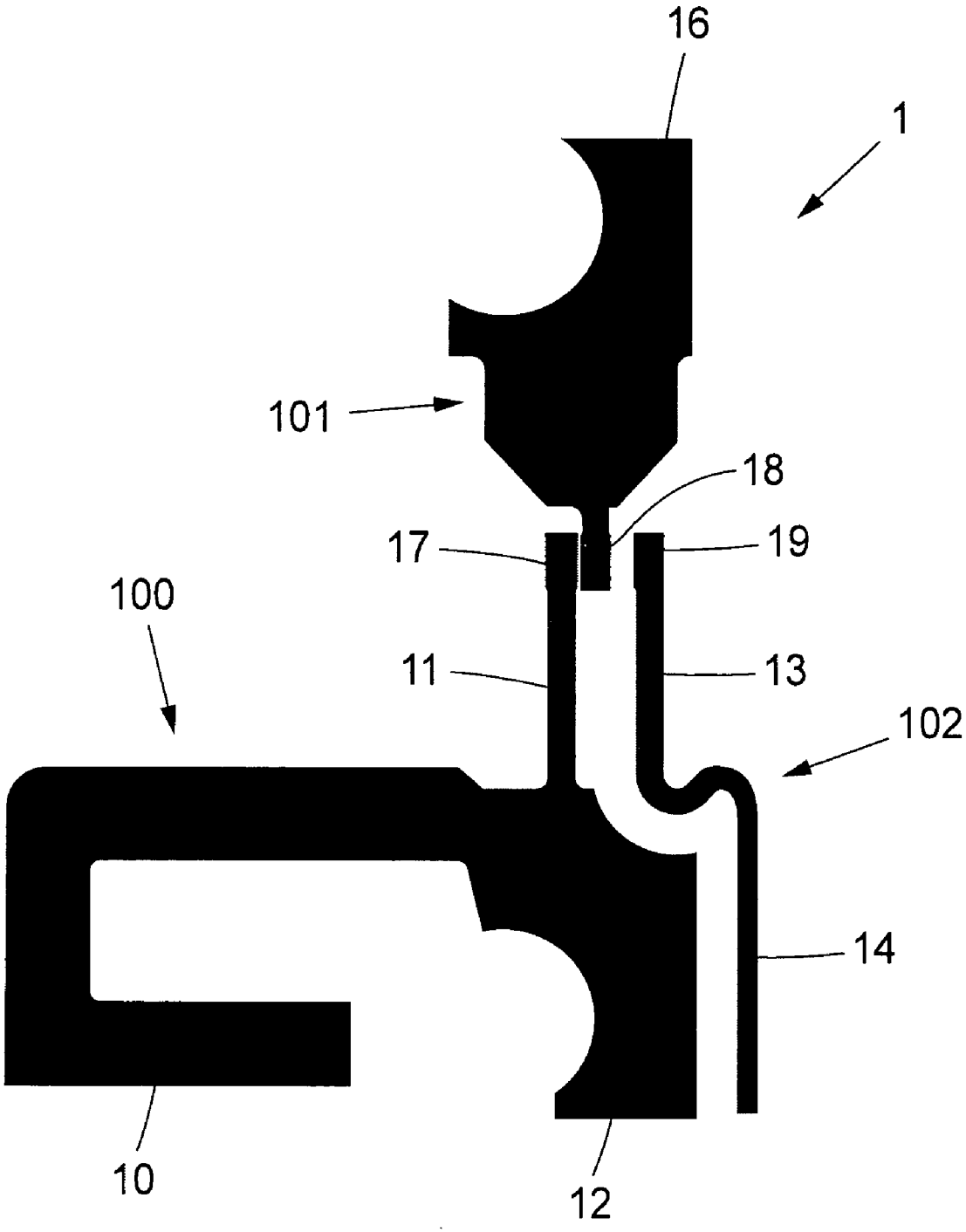
FIG. 1 is a schematic illustration of a multi-band radio antenna device according to an embodiment of the invention.

It will be understood that the figures, illustrating an exemplary embodiment of the invention, are merely schematic and are not drawn to scale. For clarity of illustration, certain dimensions may have been exaggerated while other dimensions may have been reduced. Also, where appropriate, the same reference numerals and letters are used throughout the figures to indicate the same parts and dimensions.

The following description focuses on an embodiment of the present invention applicable to a mobile telephone. However, it will be appreciated that the invention is not limited to this application, but may be applied to many other mobile communication terminals in which to implement a radio antenna design according to embodiments of the invention, including the following examples. The terms mobile or radio communication terminal comprise all mobile equipment devised for radio communication with a radio station, which radio station also may be a mobile terminal or, e.g., a stationary base station. Consequently, the term mobile communication terminal includes mobile telephones, pagers, communicators, electronic organizers, smartphones, PDAs (Personal Digital Assistants), vehicle-mounted radio communication devices, or the like, as well as portable laptop computers devised for wireless communication in, e.g., a WLAN (Wireless Local Area Network). Furthermore, since the antenna as such is suitable for, but not restricted to mobile use, the term mobile communication terminal should also be understood as to include any stationary device arranged for radio communication, such as, e.g., desktop computers, printers, fax machines and so on, devised to operate via radio communication with each other or some other radio station. Hence, although the structure and characteristics of the antenna design according to the invention is mainly described herein, by way of example, in the implementation in a mobile phone, this is not to be interpreted as excluding the implementation of the inventive antenna design in other types of mobile communication terminals, such as those listed above.

More precisely, an antenna concept or design is described herein, comprising the structure of the antenna, its performance, and its implementation in a radio communication terminal, with reference to the accompanying drawings. A schematic illustration of an antenna design in an embodiment of the invention is now given in more detail with reference to the figures.

Figure 6:
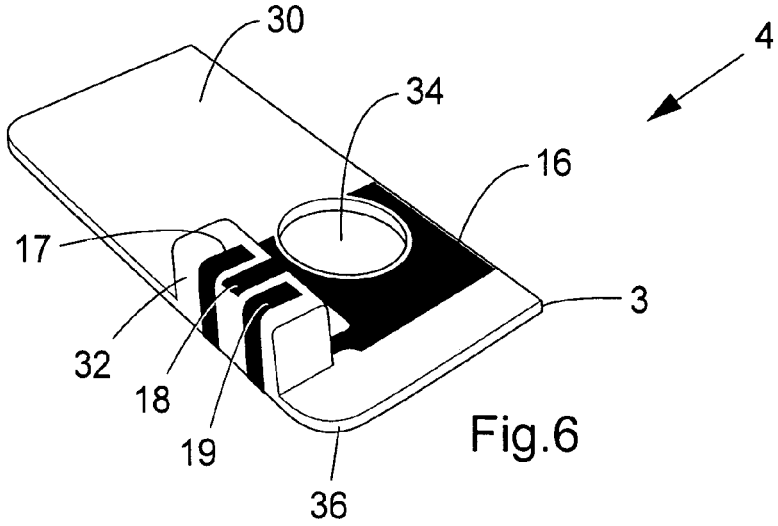
FIG. 6-8 are schematic illustrations of an antenna assembly comprising the dielectric carrier element shown in FIGS. 3-5 and the antenna device of FIG. 1 mounted thereon.
Figure 7:
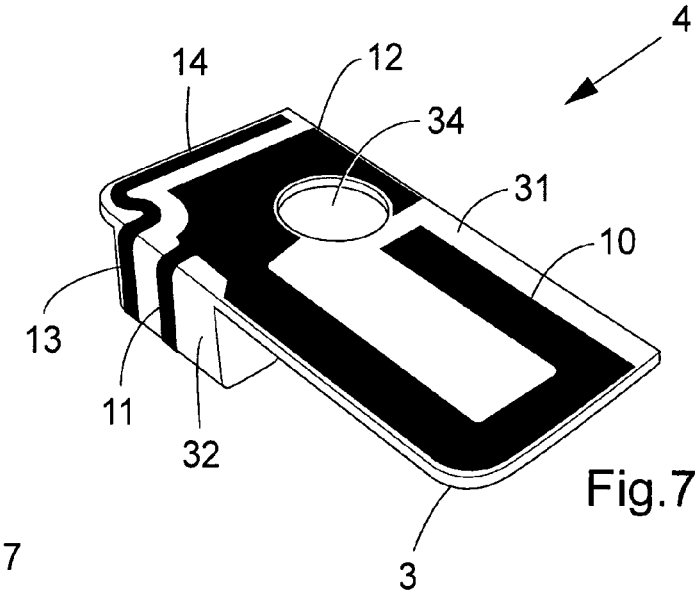
Figure 8:
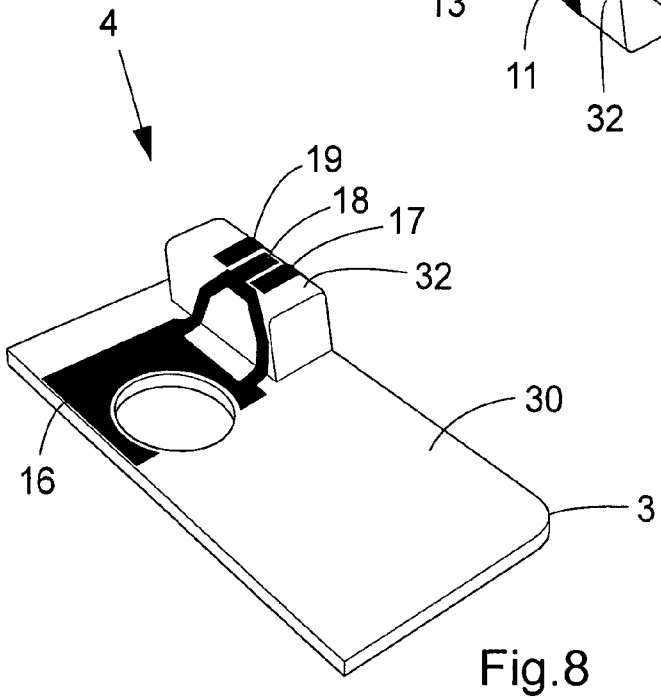

The antenna device according to an embodiment of the invention comprises a plurality of conductive antenna elements of continuous traces of conductive material. In flat form, the conductive antenna elements appear as illustrated in FIG. 1 at 1. The continuous traces comprise a first continuous trace 100, a second continuous trace 101, and a third continuous trace 102, However, for use of the antenna, the traces are fixed to a carrier element, resulting in a folded configuration of the conductive antenna elements. In particular parts 10, 12 and 14 of the first and third traces 100, 102 are arranged on one side of the carrier element and part 16 of the second conductive trace 101 is arranged on the other side of the carrier element, beneath part 12 of the first trace 100, as illustrated in FIGS. 6-8.

More precisely, the antenna has an integral feed and ground structure 17, 18, 19 electrically connected to a first, second and third radiating antenna element.

The first radiating antenna element comprises the first continuous trace 100 of conductive material. The first continuous trace has a first branch 10 tuned to radiate at first frequencies in a first, low frequency band. The first branch 10 is essentially U-shaped and connected to said feed and ground structure at a first end thereof via a conducting portion 11 to ground connection point 17. The first antenna element 100 further comprises a second branch 12 in direct connection to said first end of the first branch 10. The second branch 12 is tuned to radiate in a second, high frequency band at second frequencies approximately equal to or higher than two times the first frequencies.

The second radiating antenna element comprises a second continuous trace 101 of conductive material, wherein the second continuous trace 101 has a third branch 16. The third branch is a feeding branch, connected to a high frequency (HF) feeding connection point 18.

The third radiating antenna element comprises a third continuous trace 102 of conductive material, wherein the third continuous trace has a fourth branch 14, which is tuned to resonate in a third frequency band at third frequencies that are lower than the second frequencies, and which is capacitively coupled to the feed and ground structure and arranged substantially adjacent to the second branch 12, and substantially in the same plane when arranged on the carrier element. The third branch 14 is connected to a grounding connection point 19 via conductive trace 13.

The fourth branch 14 of the embodiment is a parasitic element that in use is responsible for tuning lower high-band resonance of the antenna device.

Higher high-band resonance is in use tuned with the inner high-band element 12, as well as the capacitive feeding structure 16, which when assembled on the carrier element is below this element, wherein these two elements 12, 16 substantially overlap, see FIGS. 6-8.

The lower resonance of the antenna device is tuned with the longer U-formed element 10, to the left in FIG. 1.

Figure 2:
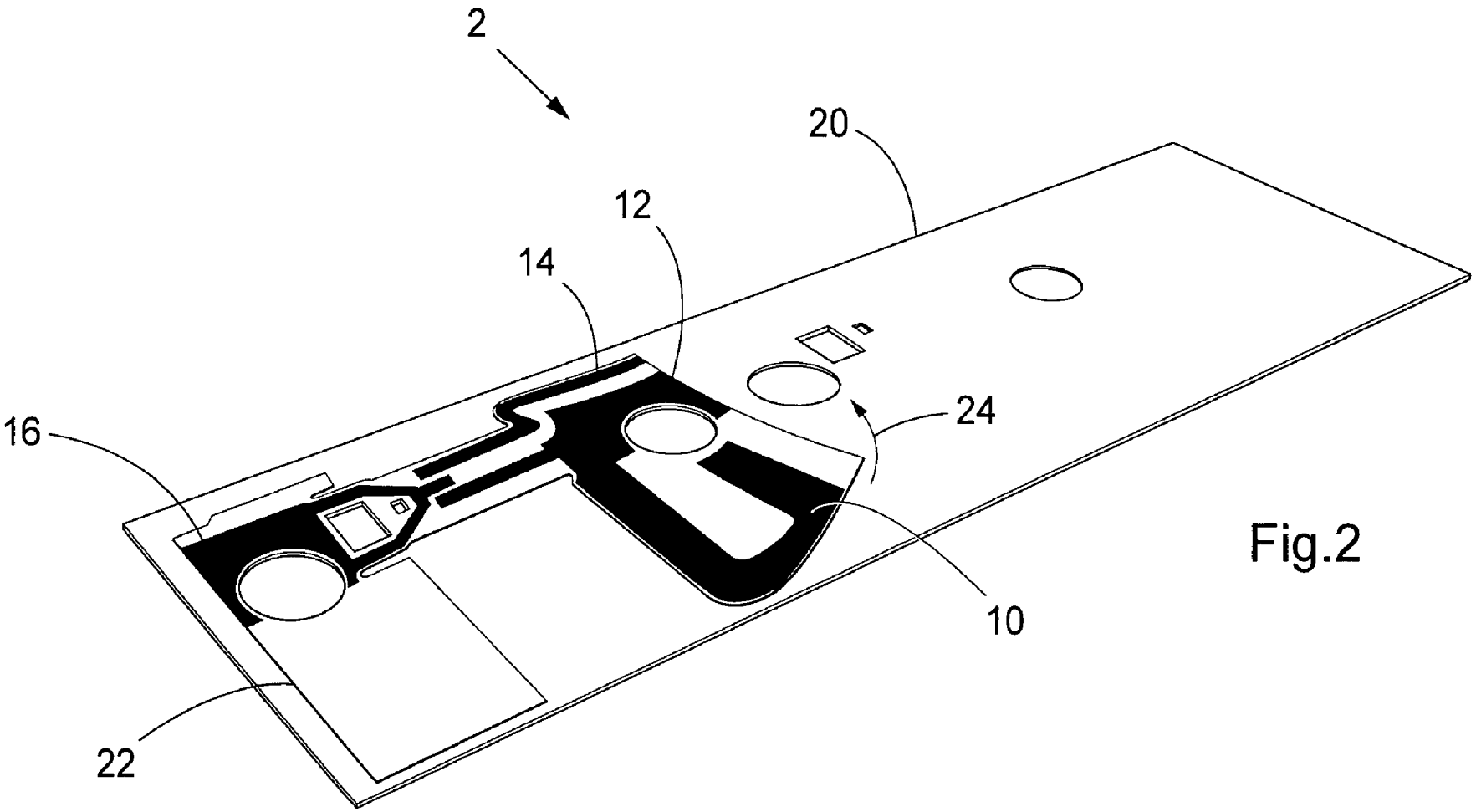
FIG. 2 is a schematic illustration of the multi-band radio antenna device of FIG. 1 arranged on an adhesive film in the process of being removed from a storage carrier during mounting the antenna device.

FIG. 2 shows that the conductive antenna traces with branches 10, 12, 14, 16 may be attached to a flat support element 22, such as in the form of a dielectric film, e.g., made of polyimide or polyester. For instance a dielectric film 22 having a thickness of about 0.1 mm and being commercially available from 3M Corporation, or a similar dielectric film may be used. The trace of conductive material and the dielectric film together form a flex film, which advantageously has an adhesive film attached to its underside for easy assembly to a radio communication terminal. The flex film may be produced and attached on a flex film transport and storage carrier 20 resulting in assembly 2. The flex film may thus easily be detached from storage carrier 20 during assembly of an embodiment of the inventive antenna device, as illustrated at arrow 24 in FIG. 2. Then the flex film may easily be attached to carrier 3, and form an antenna device 4, as shown in FIGS. 6-8.

Figure 3:
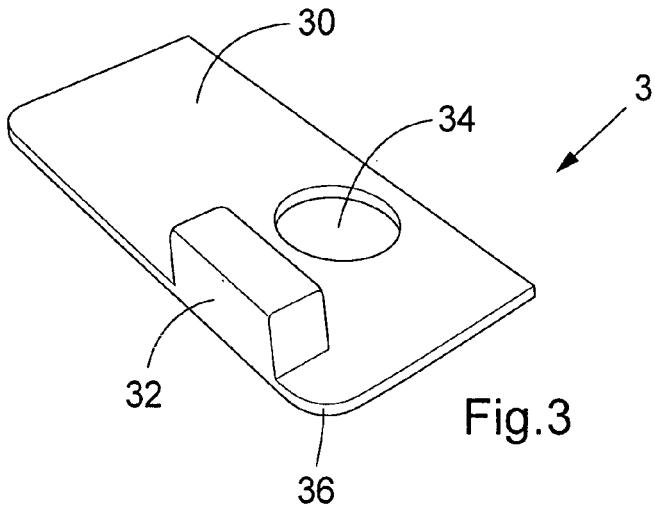
FIGS. 3-5 are schematic illustrations of a dielectric carrier element on which the antenna device of FIG. 1 is mountable when removed from a storage carrier as shown in FIG. 2.
Figure 4:
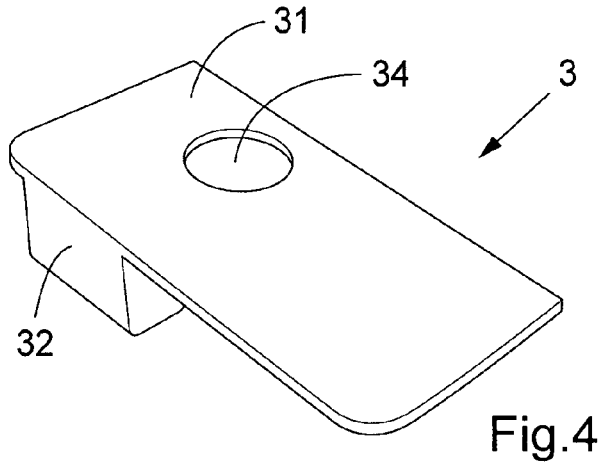
Figure 5:
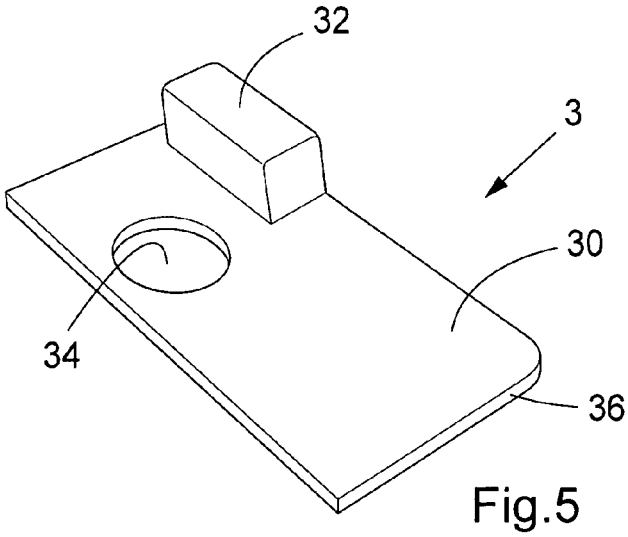

Alternatively, other embodiments of the multi-band radio antenna device may be made by directly photo-etching the continuous traces of the antenna device onto a suitable substrate, e.g., a constructive element of a radio communication terminal, such as its housing or a carrier inside such a housing, such as the carrier 3 shown in FIGS. 3-5.

A further manufacturing alternative is to use a photo-deposition technique for manufacturing the continuous traces of the antenna branches 10, 12, 14, 16.

These techniques, as well as the flexible film, allow for the inventive antenna device to be provided on irregular, e.g., curved surfaces.

Precision stamping and insert molding techniques may also be used for manufacturing the type of antenna device described herein.

FIGS. 3-5 show an exemplary carrier element 3 in different orientations. Carrier element 3 comprises a substantially planar part having an upper surface 30, a lower surface 31, and a lateral surface 36 over the thickness of the planar part and around the outer edge thereof, having a defined height. Furthermore, as illustrated in FIG. 3-5, the substantially planar part comprises an exemplary wall entrance 34, e.g., for a through connection, a camera lens, an external antenna connector, or for other construction-related purposes/details of a mobile terminal, e.g., due to other construction-related detail restrictions. The purpose of wall entrance 34 is purely of illustrative purpose illustrating the design flexibility offered by the inventive antenna design. Surfaces 30, 31 may also deviate from the substantially flat form in other embodiments of carrier element 3.

Carrier element further comprises a protruding part 32. The protruding part 32, which raises over the upper surface 30, defines the height of carrier element 3, together with the height of lateral surface 36. Protruding part 32 may for instance be suited for a mechanical connector connecting to a ground feed structure arranged thereon.

FIGS. 6-8 illustrate an antenna assembly 4 comprising antenna traces 100, 101, 102 including antenna branches 10, 12, 14, 16 and carrier element 3. As can be seen, feed and ground structure 17, 18, 19 is arranged on protruding part 32 of carrier element 3. The feed and ground structure 17, 18, 19 is electrically connected to the first, second and third radiating antenna elements. First, second and fourth branches 10, 12 and 14 are arranged on the lower surface 31. The third branch 16 is arranged on the upper surface 30, opposite to the second branch 12, so that the third branch 16 and the second branch 12 substantially overlap.

The antenna assembly 4 is in operation, when mounted in a radio communication terminal, connected to RF-circuitry (not shown). In order to achieve best impedance matching, a ground connection may comprise matching elements, such as series capacitances or inductances in order to improve performance and impedance matching.

Figure 10:
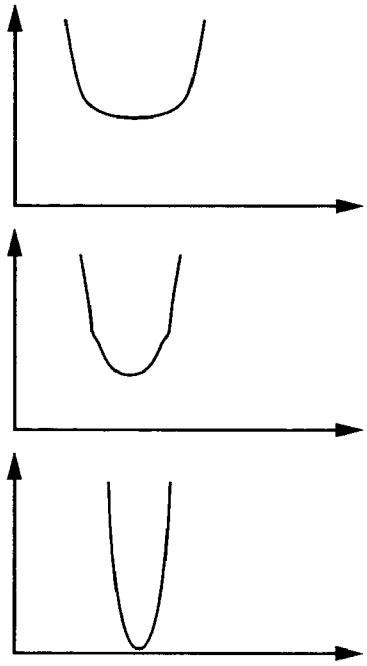
FIG. 10 includes graphs illustrating the effects of different matching elements.

For instance, a series matching component on the ground feed of the larger low-band element 10 may, according to an embodiment of the antenna device, be connected to connecting point 17 of the feed and ground structure. The series matching component may in use tune the low-band resonance and matches it, for instance, to 50 ohms. FIG. 10 shows graphs illustrating the effects of different matching elements, e.g., a capacitor having increasing capacitance from the top graph to the lower graph of FIG. 10. According to embodiments, the capacitance is between 1 pico Farad (pF) and 20 pF.

In the case of a practical example of the antenna device, a 12 pF capacitor is used as the series matching component. Overall non-limiting dimensions of an assembled exemplary antenna device according to this specific embodiment are: 37 millimeters (mm)×18 mm×about 8 mm high. Performance of this exemplary antenna device is illustrated with reference to FIG. 9.

Voltage Standing Wave Ratio (VSWR) relates to the impedance match of an antenna feed point with a feed line or transmission line of a radio communications device. To radiate radio frequency (RF) energy with minimum loss, or to pass along received RF energy to a RF receiver of a radio communication terminal with minimum loss, the impedance of an antenna should be matched to the impedance of a transmission line or the impedance of the feed point.

Figure 9:
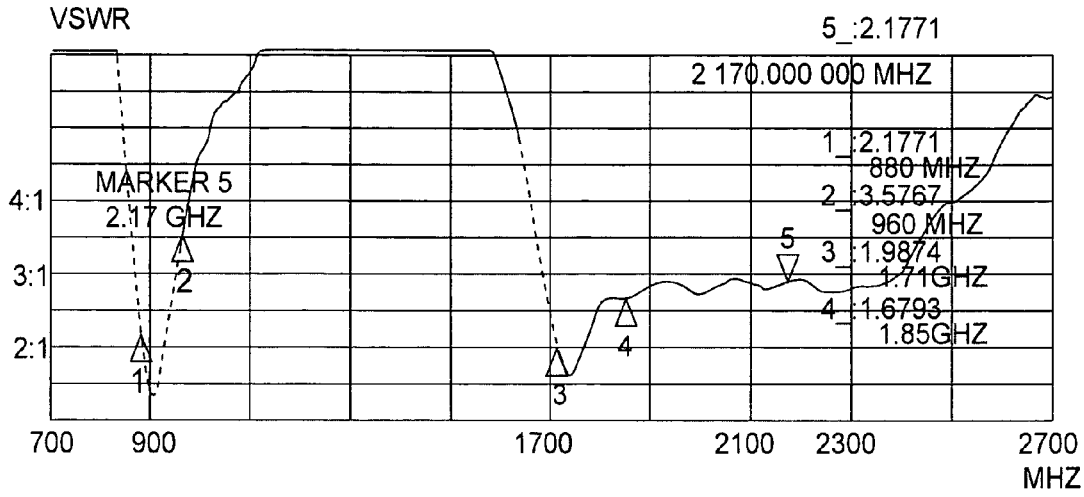
FIG. 9 includes a graph illustrating the voltage standing wave ratio (VSWR) characteristics as well as a Smith diagram showing the impedance characteristics of an exemplary multi-band radio antenna device of the type illustrated in FIGS. 6-8.
Figure 9:
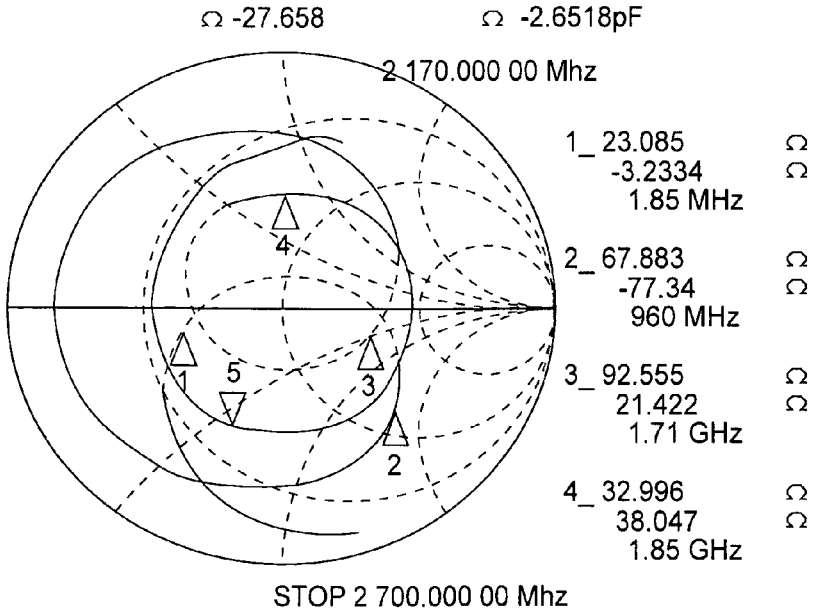

The Voltage Standing Wave Ratio (VSWR) of the antenna device 4 as shown in FIGS. 6, 7 and 8 is shown in FIG. 9. Note that the scale on the VSWR chart shown is 0.5 per division, rather than the 1 per division, which is commonly used, in order to show additional resolution.

FIG. 9 also shows a Smith diagram in the lower part of the figure. The Smith diagram shows the impedance characteristics for the multi-band radio antenna devices 4. Smith diagrams, such as shown in FIG. 9, are a familiar tool within the art and are thoroughly described in the literature, for instance in chapters 2.2 and 2.3 of "Microwave Transistor Amplifiers, Analysis and Design", by Guillermo Gonzales, Ph.D., Prentice-Hall, Inc., Englewood Cliffs, N.J. 07632, USA, ISBN 0-13-581646-7. Reference is also made to "Antenna Theory Analysis and Design", Balanis Constantine, John Wiley & Sons Inc., ISBN 0471606391, pages 43-46, 57-59. Both of these references are fully incorporated herein by reference. Therefore, the nature of Smith diagrams are not penetrated in any detail herein. However, briefly speaking, the Smith diagrams in this specification illustrate the input impedance of the antenna: $Z=R+jX$, where R represents the resistance and X represents the reactance. If the reactance $X>0$, it is referred to as inductance, otherwise capacitance. In the Smith diagram the curved graph represents different frequencies in an increasing sequence.

The horizontal axis of the diagram represents pure resistance (no reactance). Of particular importance is the point at 50 Ohms, which normally represents an ideal input impedance. The upper hemisphere of the Smith diagram is referred to as the inductive hemisphere. Correspondingly, the lower hemisphere is referred to as the capacitive hemisphere.

In more detail, a typical return loss for a multi frequency band antenna according to this embodiment of the invention is shown in FIG. 9. The return loss is here expressed as the above explained voltage standing wave ratio (VSWR) of the antenna 4 drawn on a linear frequency scale from 700 MHz to 2.7 GHz. The return loss has one distinct minimum at a low frequency band and a minimum at a specific high frequency band (marker 3 in FIG. 9) as well as a very low value over a very broad high-band (plateau connecting markers 4 and 5).

More precisely, in examining the VSWR and Smith chart, we note the following:

1) Low-band VSWR (if centered) is about 2.5 or 3:1 which is similar to most 3-band or similar antennas.

2) High-band forms a resonance which rotates around 50 Ohms at around 3:1 between 1710 and about 2300 MHz. This is a very wide bandwidth that can be further tuned to optimize gain in specific bands.

The antenna elements of embodiments of the invention consist of continuous traces of electrically conductive material, preferably copper or another suitable metal with very good conductive properties. An antenna connector serves to connect the antenna to radio circuitry, e.g., provided on a printed circuit board in, for example, a mobile telephone. The antenna connector may be implemented by any of a plurality of commercially available antenna connectors, such as a leaf-spring connector or a pogo-pin connector.

Moreover, the radio circuitry as such forms no essential part of the present invention and is therefore not described in more detail herein. As will be readily realized by one skilled in the art, the radio circuitry will comprise various known HF (high frequency) and baseband components suitable for receiving a radio frequency (RF) signal, filtering the received signal, demodulating the received signal into a baseband signal, filtering the baseband signal further, converting the baseband signal to digital form, applying digital signal processing to the digitalized baseband signal (including channel and speech decoding), etc. Conversely, the HF and baseband components of the radio circuitry will be capable of applying speech and channel encoding to a signal to be transmitted, modulating it onto a carrier wave signal, supplying the resulting HF signal to the antenna device 4, etc.

Figure 11:
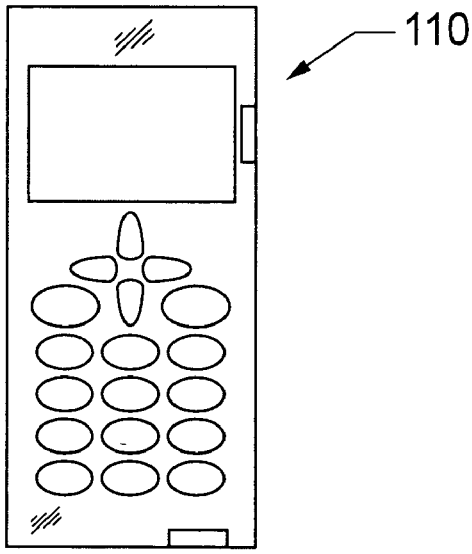
FIG. 11 is a schematic illustration of a radio communication terminal devised for multi-band radio communication.

FIG. 11 illustrates a radio communication terminal 110 in the embodiment of a cellular mobile phone devised for multi-band radio communication. The terminal 110 comprises a chassis or housing, carrying a user audio input in the form of a microphone and a user audio output in the form of a loudspeaker or a connector to an ear piece (not shown). A set of keys, buttons or the like constitutes a data input interface is usable, e.g., for dialing, according to the established art. A data output interface comprising a display is further included and is devised to display communication information, address list, etc., in a manner well known to the skilled person. The radio communication terminal 110 includes radio transmission and reception electronics (not shown), and is devised with a built-in antenna device inside the housing.

In some cases it might be advantageous to have the shown antenna design, or a variation thereof, depending on various requirements, such as antenna performance versus implementing cost or design flexibility.

A fastening element may be conveniently integrated with the antenna device for mechanically fixing the antenna device 4 to a radio communication device.

Embodiments of the present invention may provide an alternative antenna structure to known structures that is suitable for built-in antennas, at the same time it may have a very wide bandwidth of a high-frequency band, which can allow the antenna to be operated at a plurality of frequency bands.

The multi-band radio antenna is a compact antenna device, which may be disposed inside the casing of a mobile communication terminal in order to make the terminal compact and have a low weight.

Embodiments of the invention may enable manufacturers of mobile radio communication terminals to have a built-in advantageous antenna device, which may be manufactured in large series at low costs.

In summary, embodiments of the invention use capacitive coupling to excite an antenna element. Unlike the designs of the prior art, as, e.g., in U.S. Pat. No. 6,650,294 of Ying et. al., where the low-band is excited, the high-band may be excited in embodiments of the invention. This limits the bandwidth of the low-band to a single band, but improves the gain on this band. Additionally, exciting the high-band element in this manner serves to excite significant high-band currents on the low-band branch. The addition of a parasitic element adjacent to the high-band branch serves to significantly widen the bandwidth and makes it possible to achieve DCS to UMTS at under 3:1 VSWR with acceptable gain. Matching components on the main ground contact allow one to tune the low-band resonance and match it to 50 Ohms for maximal performance.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The foregoing has described the principles, an embodiment and modes of operation of the embodiment of the present invention. However, the invention should not be construed as being limited to the particular embodiments discussed above. For example, while the antenna of the present invention has been discussed primarily as being a radiating device/element, one skilled in the art will appreciate that the antenna of the present invention would also be used as a sensor for receiving information at specific frequencies. Similarly, the dimensions of the various elements may vary based on the specific application, for instance other embodiments than those described may have a variant of the illustrated U-formed radiating portion. Thus, the above-described embodiment should be regarded as illustrative rather than restrictive, and it should be appreciated that variations may be made in other embodiments by those skilled in the art without departing from the scope of the present invention as defined by the following claims.

What is claimed is:

1. A multi-band radio antenna device for a radio communication terminal, comprising:

a first radiating element;

a second radiating element; and an integral feed and ground structure electrically connected to the first radiating antenna element and the second radiating antenna element, said first radiating antenna element comprising a first continuous trace of conductive material, the first continuous trace comprising:

a first branch tuned to radiate at first frequencies in a first frequency band, and a second branch tuned to radiate in a second frequency band at second frequencies approximately equal to or greater than two times the first frequencies, and said second radiating antenna element comprising a second continuous trace of conductive material, the second continuous trace comprising a third branch capacitively coupled to said second branch, wherein said third branch is not capacitively coupled to said first branch.

2. The multi-band radio antenna device according to claim 1, wherein said third branch is a feeding branch of said multi-band radio antenna device, connected to a high frequency feeding connection point of said integral feed and ground structure.

3. The multi-band radio antenna device according to claim 2, further comprising a third radiating antenna element comprising a third continuous trace of conductive material, wherein the third continuous trace has a fourth branch tuned to resonate in a third frequency band at third frequencies that are higher than the second frequencies, and which is capacitively coupled to the feed and ground structure and arranged substantially adjacent to the second branch.

4. The multi-band radio antenna device according to claim 3, wherein said fourth branch is substantially arranged in the same plane as said first branch and said second branch.

5. The multi-band radio antenna device according to claim 3, wherein said fourth branch is a parasitic element that in use tunes a lower high-band resonance of the antenna device.

6. The multi-band radio antenna device according to claim 5, wherein the second branch is an inner high-band element of the antenna device, and the third branch is a capacitive feeding structure, and wherein a higher high-band resonance in use is tuned with the second branch and the third branch the third branch being assembled on a carrier element opposite said second branch, wherein said second branch and said third branch substantially overlap.

7. The multi-band radio antenna device according to claim 6, wherein said carrier element is a dielectric carrier element and said first, second and third conductive antenna traces are attached to said carrier element.

8. The multi-band radio antenna device according to claim 7, wherein said second branch and said third branch that substantially overlap are arranged on opposite surfaces of said dielectric carrier element, having a dielectric material of said carrier element in-between.

9. The multi-band radio antenna device according to claim 1, wherein the first branch is a U-shaped element having a lower resonance of the antenna device in said first frequency band, wherein said lower resonance is tuned with said U-shaped element.

10. The multi-band radio antenna device according to claim 1, wherein said first branch of said first continuous trace of conductive material of said first radiating antenna element is connected to a ground feed of said feed and ground structure, and wherein a series matching component is connected between said ground feed and ground, whereby said matching component in use tunes the lower resonance of the antenna device in said first frequency band and matches it to a predefined impedance.

11. The multi-band radio antenna device according to claim 10, wherein said matching element is a capacitor having a capacitance.

12. The multi-band radio antenna device according to claim 10, wherein said capacitance is between 1 pico Farad and 20 pico Farads and said impedance is 50 ohms.

13. The multi-band radio antenna device according to claim 1, further comprising a carrier element that comprises a substantially planar part having an upper surface, a lower surface, a lateral surface over the thickness of the planar part and around the outer edge thereof, and having a defined height.

14. The multi-band radio antenna device according to claim 13, wherein the substantially planar part comprises a wall entrance of the mobile terminal used for at least one of a through connection, a camera lens, or an external antenna connector.

15. The multi-band radio antenna device according to claim 14, wherein said carrier element further comprises a protruding part protruding over said upper surface, wherein said protruding part has said integral feed and ground structure arranged thereon.

16. The multi-band radio antenna device according to claim 15, wherein said protruding part is configured as part of a mechanical connector for said integral feed and ground structure.

17. The multi-band radio antenna device according to claim 13, wherein said first and second branches are arranged on said lower surface, and wherein said third branch is arranged on the upper surface, opposite to the second branch, and wherein said third branch and the second branch substantially overlap.

18. A radio communication terminal for multi-band radio communication, comprising:

an integral feed and ground structure electrically connected to a first radiating antenna element and a second radiating antenna element, said first radiating antenna element comprising a first continuous trace of conductive material, the first continuous trace comprising:

a first branch tuned to radiate at first frequencies in a first frequency band, and a second branch tuned to radiate in a second frequency band at second frequencies approximately equal to or greater than two times the first frequencies; and said second radiating antenna element comprising a second continuous trace of conductive material, the second continuous trace having a third branch capacitively coupled to said second branch and not capacitively coupled to said first branch.

19. The radio communication terminal according to claim 18, wherein the radio communication terminal is a mobile telephone.

20. In a radio communication terminal including a multi-band radio antenna device comprising:

an integral feed and ground structure electrically connected to a first radiating antenna element and a second radiating antenna element, said first radiating antenna element comprising a first continuous trace of conductive material, the first continuous trace comprising:

a first branch tuned to radiate at first frequencies in a first frequency band, and a second branch, tuned to radiate in a second frequency band at second frequencies approximately equal to or greater than two times the first frequencies; and said second radiating antenna element comprising a second continuous trace of conductive material, the second continuous trace having a third branch;

a method of tuning said second frequency band, said method comprising:

capacitively coupling said third branch to said second branch through a common dielectric carrier element; and arranging said third branch to not be capacitively coupled to said first branch.

* * * * *